US008573432B2

(12) United States Patent
Emanuele, III et al.

(10) Patent No.: US 8,573,432 B2
(45) **Date of Patent: *Nov. 5, 2013**

(54) VENT OPENING MECHANISM

(71) Applicants: Arthur Joseph Emanuele, III, Phoenix, AZ (US); Robert Clarke Church, Paradise Valley, AZ (US)

(72) Inventors: Arthur Joseph Emanuele, III, Phoenix, AZ (US); Robert Clarke Church, Paradise Valley, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/770,950

(22) Filed: Feb. 19, 2013

(65) Prior Publication Data

US 2013/0161328 A1 Jun. 27, 2013

Related U.S. Application Data

(63) Continuation of application No. 12/859,504, filed on Aug. 19, 2010, now Pat. No. 8,397,935.

(60) Provisional application No. 61/276,373, filed on Sep. 10, 2009.

(51) Int. Cl.

| | |
|---|---|
| ***B65D 17/34*** | (2006.01) |
| ***B65D 17/00*** | (2006.01) |
| ***B21D 51/38*** | (2006.01) |

(52) U.S. Cl.

CPC ..... *B65D 17/161* (2013.01); *B21D 51/383* (2013.01)

USPC ..... 220/271; 413/17

(58) Field of Classification Search

CPC .... B65D 17/163; B65D 17/161; B65D 17/16; B21D 51/383; B21D 51/38

USPC ..... 220/271, 270, 266, 265, 277, 212, 220/254.2, 254.1, 269, 906, 200; 413/17, 413/16, 15, 14, 12; 53/492

IPC ..... B65D 17/34, 17/42

See application file for complete search history.

(56) References Cited

U.S. PATENT DOCUMENTS

| | | | | |
|---|---|---|---|---|
| 3,301,434 | A | | 1/1967 | Harvey et al. |
| 3,833,144 | A | | 9/1974 | Bollmann et al. |
| 4,003,494 | A | * | 1/1977 | Smith et al. ..... 220/268 |
| 4,008,823 | A | | 2/1977 | Tarro |
| 4,043,479 | A | | 8/1977 | Khoury |
| 4,280,427 | A | | 7/1981 | Potts |
| 4,333,581 | A | | 6/1982 | Flansburg |
| 4,463,866 | A | | 8/1984 | Mandel |
| 4,585,140 | A | | 4/1986 | Lambert et al. |
| 5,011,037 | A | | 4/1991 | Moen et al. |

(Continued)

*Primary Examiner* — Jacob K Ackun
*Assistant Examiner* — Robert J Hicks
(74) *Attorney, Agent, or Firm* — Stetina Brunda Garred & Brucker

(57) ABSTRACT

An improved drink can with a drink opening and a vent opening are positioned opposite from ouch other with respect to a central portion of a top end of a drink can. The tab is attached to the central portion and can be pulled upward to open the drink opening then pushed back downward to open the vent opening. To aid in opening the vent opening with the tab, the vent opening may have a ridge to provide additional leverage when the tab pushes downward on a score line that defines the vent opening. The tab may be enlarged so that upon breakage of the score line to the vent opening, the tab contacts the top end of the can and does not allow the user's finger to proceed into the vent opening and possibly cut the user's finger.

19 Claims, 7 Drawing Sheets

(56) References Cited

U.S. PATENT DOCUMENTS

| | | | |
|---|---|---|---|
| 5,285,919 | A | 2/1994 | Recchia |
| 5,307,947 | A | 5/1994 | Moen et al. |
| 5,397,014 | A | 3/1995 | Aydt |
| 5,494,184 | A | 2/1996 | Noguchi et al. |
| 5,555,992 | A | 9/1996 | Sedgeley |
| 5,695,085 | A | 12/1997 | Hadener |
| 5,819,973 | A | 10/1998 | Traub, Sr. et al. |
| 7,513,383 | B2 | 4/2009 | Hwang |
| 2003/0098306 | A1 | 5/2003 | Cho |
| 2003/0189045 | A1 | 10/2003 | Hwang |
| 2011/0108552 | A1 | 5/2011 | Tamarit Rios |

* cited by examiner

VENT OPENING MECHANISM

CROSS-REFERENCE TO RELATED APPLICATIONS

This application is a continuation patent application of U.S. patent application Ser. No. 12/859,504, filed Aug. 19, 2010 now U.S. Pat. No. 8,397,935 which claims the benefits of U.S. Prov. Pat. App. Ser. No. 61/276,373 filed on Sep. 10, 2009, the entire contents of which are expressly incorporated herein by reference.

STATEMENT RE: FEDERALLY SPONSORED RESEARCH/DEVELOPMENT

Not Applicable

BACKGROUND

The present invention relates to an improved drink can.

Fluids such as alcohol, carbonated drinks, etc. may typically be transported from one location to another in a fluid tight can. The can may have an opening for pouring the fluid contained within the can either as the user is drinking the fluid or pouring the fluid into a separate container (e.g., glass). Unfortunately, during the pouring process, the fluid within the can blocks the entire opening through which the fluid is being poured out of. As a result, air must enter the drink can through such opening and may cause the fluid exiting the can to have a turbulent flow. Such turbulent flow may cause the fluid to splash and miss the glass or cause the user to spill the fluid on himself/herself. Moreover, such construction also reduces the flow rate of the fluid flowing out of the opening since air must be reintroduced into the can to allow additional fluid to flow out of the can.

Accordingly, there is a need in the art for an improved drink can.

BRIEF SUMMARY

The improved can disclosed herein addresses the needs discussed above, discussed below and those that are known in the art.

The improved can has a vent opening which is positioned opposite from a drink opening of a can. The vent opening when opened allows the fluid within the can to be poured out smoothly out of the drink opening by replacing the fluid exiting the drink opening with air entering by way of the vent opening instead of the drink opening. To this end, the top end of the can may have a tab (e.g., conventional tab, solid tab, etc.) for opening the can in a traditional manner. After the tab opens the drink opening, the tab is pushed back downward and on top of a ridge formed on the top end of the can. When the user presses down on the tab, the tab pushes down on the ridge and the ridge breaks a score line defining the vent opening. The user continues to press downward on the tab until the score line for the vent opening is broken thereby opening the vent opening. The tab is over sized with respect to the vent opening so that the tab contacts the top end of the can and the user's finger does not proceed through the vent opening. The user's finger resides safely on top of the top end of the can and does not proceed through into the vent opening which could cut the user's finger. The ridge is preferably disposed between the score line for the vent opening and a central portion of the top end of the can. Moreover, it is preferable that the ridge be positioned as close to the score line as possible and is preferably closer to the score line of the vent opening compared to the central portion of the top end of the can. Alternatively, the ridge may be formed on the underside of the tab instead of on the top end of the can. The ridge functions in a similar manner as the ridge in the first embodiment to apply leverage so as to break the score line to the vent opening.

More particularly, a can having fluid contained therein is disclosed. The can may comprise a bottom end, a cylindrical sidewall, a top end and a tab. The cylindrical sidewall may have the bottom end attached to a first side of the cylindrical sidewall. The top end may be attached to the sidewall on an opposed second side of the cylindrical wall to form an enclosed volume in which the fluid is contained. The top end may have a first score line defining a drinking periphery formed in the top end and a second score line defining a vent opening. The first score line may be positioned opposite the second score line with respect to a center portion of the top end. The top end may have a raised ridge interposed between the center portion of the top end and the second score line. The tab may define a drink opening portion and a vent opening portion. The drink and vent opening portions may be joined to each other at an intermediate portion wherein the intermediate portion is pivotally attached to the center portion of the top end. The drink opening portion is also disposed over the top end on an interior side of the first score line. The vent opening portion is disposed over the top end with a solid portion of the vent opening portion disposed over the raised ridge to provide leverage so that a user can press the vent opening portion of the tab into the top end to break the second score line.

The vent opening portion may also be disposed over the second score line to protect the user's finger from being cut from a sharp edge formed at the second score line after rupturing the second score line with the vent opening portion. The vent opening portion may cover the second score line to prevent insertion of the vent opening portion and the user's finger when the user depresses the ridge to break the score line.

The raised ridge may be stamped into the top end. The raised ridge may have opposed sloping sides that are joined to each other at a raised central ridge line.

A distal end of the drink opening portion of the tab may be closer to the center portion of the top end than the first score line so as to provide leverage when the user lifts the vent opening portion to break the first score line and provide for the drink opening. The raised ridge may be closer to the second score line compared to the center portion of the top end.

In another embodiment, a can having fluid contained therein wherein the can comprises a bottom end, a cylindrical sidewall, a top end and a tab is disclosed. The cylindrical sidewall has the bottom end attached to a first side of the cylindrical sidewall. The top end may be attached to the sidewall on an opposed second side of the cylindrical wall to form an enclosed volume in which the fluid is contained. The top end may have a first score line defining a drinking periphery formed in the top end and a second score line defining a vent opening. The first score line may be positioned opposite the second score line with respect to a center portion of the top end. The tab may define a drink opening portion and a vent opening portion. The drink and vent opening portions may be joined to each other at an intermediate portion. The intermediate portion may be pivotally attached to the center portion of the top end. The drink opening portion may be disposed over the top end on an interior side of the first score line. The vent opening portion may be disposed over the top end with a solid portion of the vent opening portion disposed over the second score line. An underside of the vent opening portion may have a raised ridge. The raised ridge may be aligned between the center portion of the top end and the second score line to provide leverage so that a user can press the vent opening portion of the tab into the top end to break the second score line.

The vent opening portion may be disposed over the second score line to protect the user's finger from being cut with a sharp edge formed at the second score line after rupturing the second score line with the vent opening portion. Also, the vent opening portion may cover the second score line to prevent insertion of the vent opening portion and the user's finger when the user depresses the vent opening portion to break the score line.

A method of opening a can containing a fluid is also disclosed. The method may comprise the steps of lifting a vent opening portion of a tab to pivot the tab about an intermediate portion of the tab so as to provide leverage to a drink opening portion of the tab; pressing the drink opening portion into the top end to break a first score line on a top end of the can; breaking the first score line on the top end of the can; contacting the vent opening portion into a raised ridge formed in the top end of the can; pushing the vent opening portion into the raised ridge formed in the top end of the can to break a second score line on the top end of the can; and breaking the second score line on the top end of the can.

The method may further comprise the step of limiting the movement of the vent opening portion to stay above the top end to prevent sharp edges of a vent opening from cutting the user's finger.

In another embodiment, another method of opening a can containing a fluid is disclosed. The method may comprise the steps of lifting a vent opening portion of a tab to pivot the tab about an intermediate portion of the tab so as to provide leverage to a drink opening portion of the tab; pressing the drink opening portion into the top end to break a first score line on a top end of the can; breaking the first score line on the top end of the can; contacting a raised ridge of the vent opening portion into the top end of the can; pushing the vent opening portion so that the raised ridge of the vent opening portion breaks a second score line on the top end of the can; and breaking the second score line on the top end of the can.

In still a further embodiment, another method of opening a can containing a fluid is disclosed. The method may comprise the steps of pressing downward on a vent opening portion of a tab; breaking a second score line to open the vent opening; lifting a vent opening portion of a tab to pivot the tab about an intermediate portion of the tab so as to provide leverage to a drink opening portion of the tab; pressing the drink opening portion into the top end to break a first score line on a top end of the can; and breaking the first score line on the top end of the can.

The method may further comprise the step of pressing a ridge formed on an underside of the tab into the top end of the can. Alternatively, the method may further comprise the step of contacting an underside surface of the tab into a raised ridge formed in the top end of the can.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
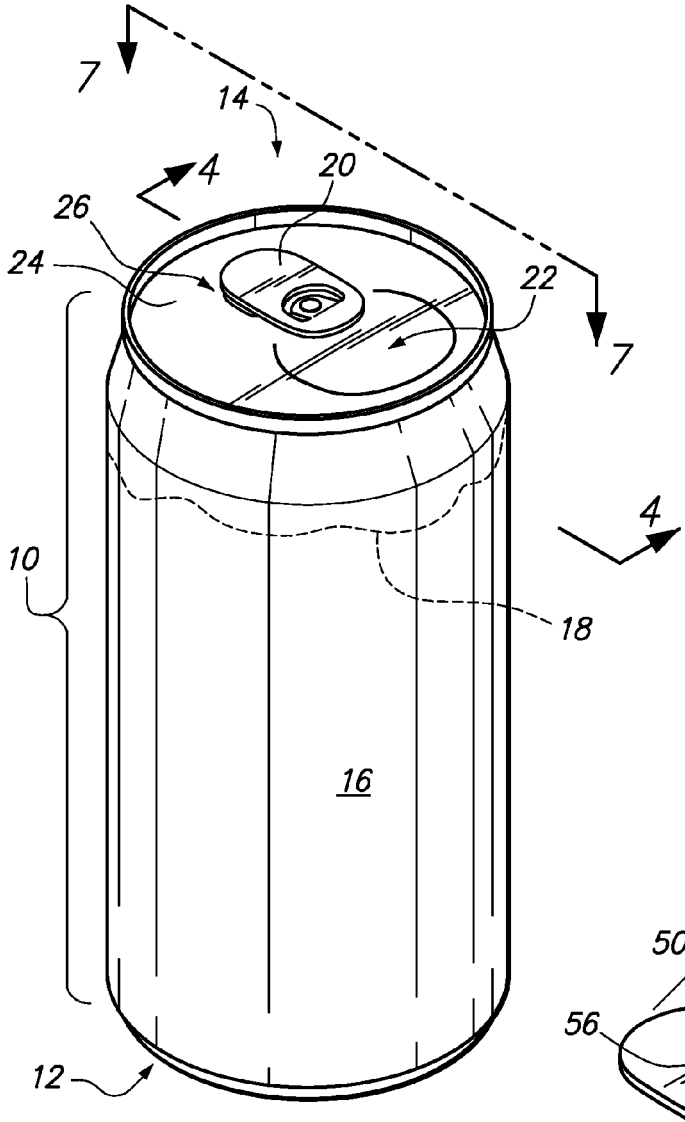
FIG. 1 is a perspective view of an improved beverage can including a vent opening and a drink opening.

Referring now to the drawings, FIG. 1 illustrates a can 10 used to hold fluid 18. The can 10 defines a bottom end 12, a top end 14 and a sidewall 16. The top end and bottom ends 14, 12 may be attached to the opposed ends of the sidewall 16 to form a container to hold fluid 18. The can 10 may provide a fluid tight container so that the fluid 18 does not escape from the can 10 during transportation and prior to use. During use, the user may flip up a tab 20 to open drinking opening 22 (see FIG. 5) so that the fluid 18 may be poured out of the can 10 (see FIG. 3). The tab 20 may then be flipped back downward and pushed toward an upper panel 24 of the top end 16 to open the vent opening 26 (see FIG. 6) so that fluid 18 may flow smoothly out of drink opening 22 when poured (see FIG. 3). When the tab 20 is flipped back downward and pushed toward the upper panel 24 of the top end 16, the tab 20 pushes upon the ridge 25 disposed closely to a score line 30 defining the vent opening 26. The ridge 25 assists in providing the needed leverage so that the user can break the score line 30.

The top end 14 of the can 10 may be fabricated from a stamping process. The stamping process may form the first and second score lines 28, 30 which are weakened areas in the top end 14 that define the vent opening 26 and the drink opening 22. The score lines 28, 30 may be indentations formed by a die which promotes separation at the score lines 28, 30. The stamping process may also form the ridge 25 in the top end 14. The tab 20 may also be formed by the stamping process. The upper panel 24 of the top end 14 and the tab 20 may be attached to each other in a subsequent operation. Moreover, the top end 14 may be attached to the sidewall 16 in a separate operation.

Figure 2:
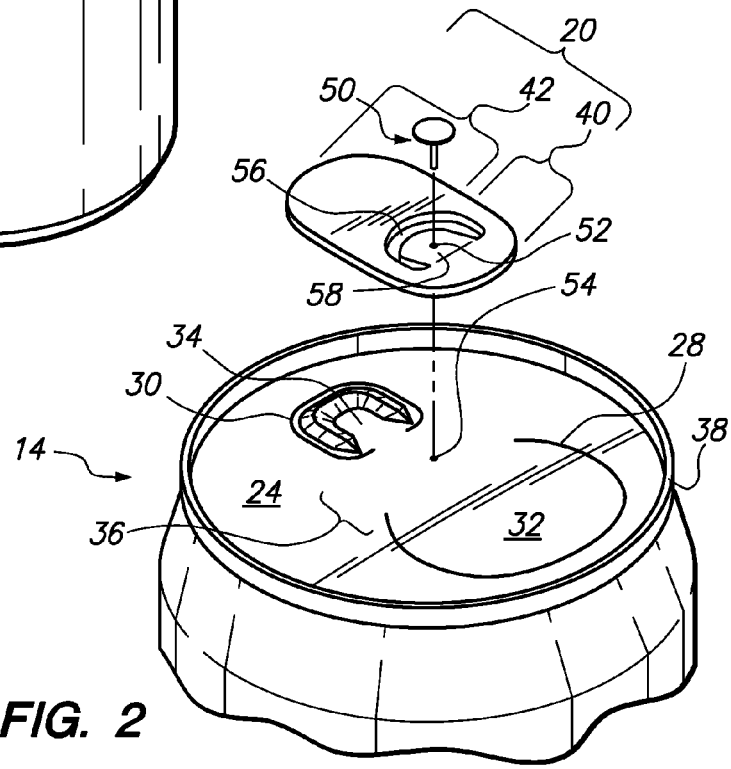
FIG. 2 is an enlarged exploded view of the top end of the improved can shown in FIG. 1.

More particularly, referring now to FIG. 2, an enlarged view of the top end 14 of the can 10 is shown. The tab 20 is exploded off of the upper panel 24 for the purposes of clarity. The upper panel 24 may be formed by a stamping process. During the stamping process, first and second score lines 28, 30 are formed in the upper panel 24. The first and second score lines 28, 30 do not complete an entire circle so that the cut out portions 32, 34 of the upper panel 24 can remain attached to the central portion 36 after opening the drink opening 22 and the vent opening 26. The first score line 28 may extend from the central portion 36 out close to the periphery 38 then back to the central portion 36 of the upper panel 24. The first score line 28 may be curved and define the drink opening 22 when the cut off portion 32 is broken away from the upper panel 24 at the first score line 28. The curved configuration of the first score line 28 may provide for sufficient flow output of the fluid 18 through the drink opening 22. The first score line 28 extends close to the periphery 38 to facilitate drinking.

Figure 3:
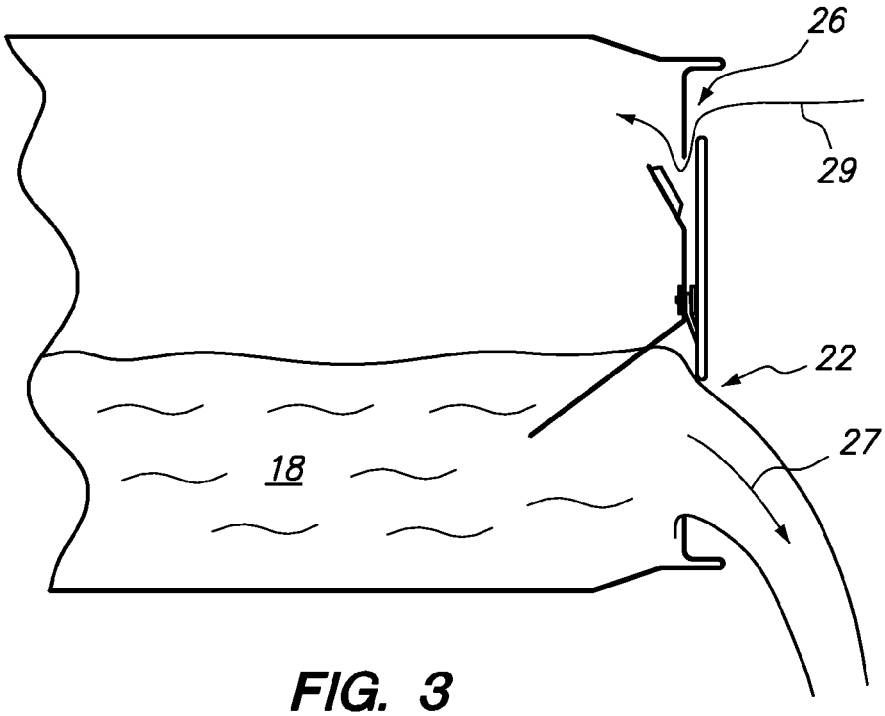
FIG. 3 is a cross sectional view of the improved can shown in FIG. 1 for providing smooth pouring of fluid out of the drink opening.

The vent opening 26 allows for smoother flow of fluid out of the drink opening 22, as shown in FIG. 3. In particular, when the vent opening 26 is opened, the fluid 18 flowing out of the can 10 through the drink opening 22 is shown by arrow 27. Fluid is replaced with air through the vent opening 26 as shown by arrow 29. This provides for a smoother flow of fluid 18 out of the drink opening 22 when pouring the fluid 18 out of the can 10.

The second score line 30 may have a linear length shorter than the linear length of the first score line 28. The vent opening 26 defined by the second score line 30 may be sufficiently large to provide an air inlet with sufficient flow rate to keep up with the output flow rate of the fluid 18 exiting the drink opening 22. The vent opening 26 may be smaller than the drink opening 22. As shown in FIG. 2, the second score line 30 may extend from the central portion 36 toward the outer periphery 38 of the upper panel 24 but not as far as the first score line 28 then back to the central portion 36. The second score line 30 defines the vent opening 26 which permits air to flow into the can 10 during pouring of the fluid 18 out of the drink opening 22, as shown in FIG. 3.

Figure 4:
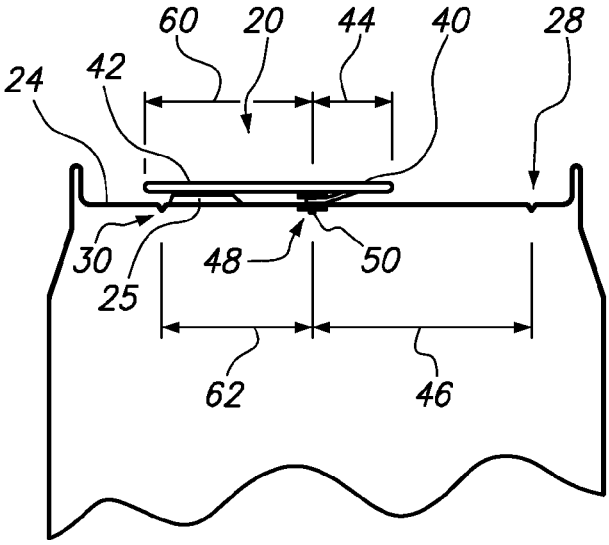
FIG. 4 is a cross sectional view of the improved can shown in FIG. 1.
Figure 5:
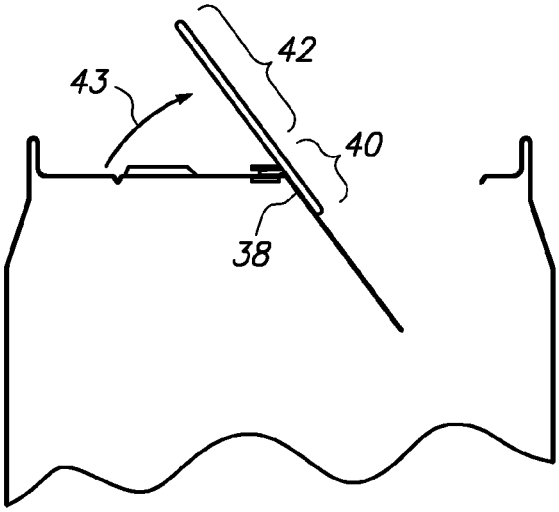
FIG. 5 is a cross sectional view of the improved can illustrating a tab being pulled upward to open the drink opening.
Figure 6:
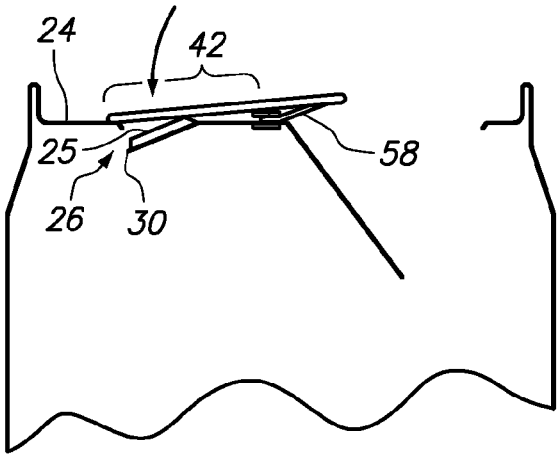
FIG. 6 is a cross sectional view of the improved can wherein the tab is pushed downward to open the vent opening.

Referring back to FIGS. 2 and 4, the tab 20 may define a drink opening portion 40 and a vent opening portion 42. The size of the drink opening portion 40 may be smaller than the size of the cut out portion 32 and the drink opening 22, as shown in FIG. 2. The drink opening portion 40 is smaller so that additional leverage can be placed upon the cut out portion 32 as the user lifts the vent opening portion 42, as shown by arrow 43 in FIG. 5. Referring now to FIG. 4, a length 44 of the drink opening portion 40 is substantially smaller than a distance 46 measured from a pivot point 48 to the furthest part of the first score line 28. The pivot point 48 of the tab 20 may be defined by rivet 50, shown in FIGS. 2 and 4. The rivet 50 attaches the tab 20 to the central portion 36 of the upper panel 24. The rivet 50 is fed through hole 52 of the tab 20 and hole 54 of the upper panel 24. The rivet 50 then attaches the tab 20 to the upper panel 24. The tab 20 may additionally have a U-shaped cut out 56 formed about the hole 52. The U-shaped cut out 56 enables the tab 20 to bend at attached portion 58 when the vent opening portion 42 is lifted up as shown in FIG. 5 and pushed back downward as shown in FIG. 6. The tab 20 may be fabricated from an aluminum material which is fairly malleable. The tab 20 may be bent once up and down and is preferably not bent anymore than that to prevent breakage of the attached portion 58 of the tab 20.

Referring back to FIG. 2, the tab 20, and more particularly the vent opening portion 42, may be solid so that the vent opening portion 42 may make full contact with the ridge 25. However, it is also contemplated that the vent opening portion 42 may have other configurations such as S-shaped, square shaped, triangular shaped, etc. The ridge 25 may also have other shapes. The ridge 25 and the vent opening portion 42 of the tab 20 may have corresponding shapes so that the vent opening portion 42 places pressure on the ridge 25 and breaks the score line 30. Once the score line 30 is broken, the vent opening portion 42 may be sufficiently large to prevent entry of the person's finger into the vent opening 26.

Figure 7:
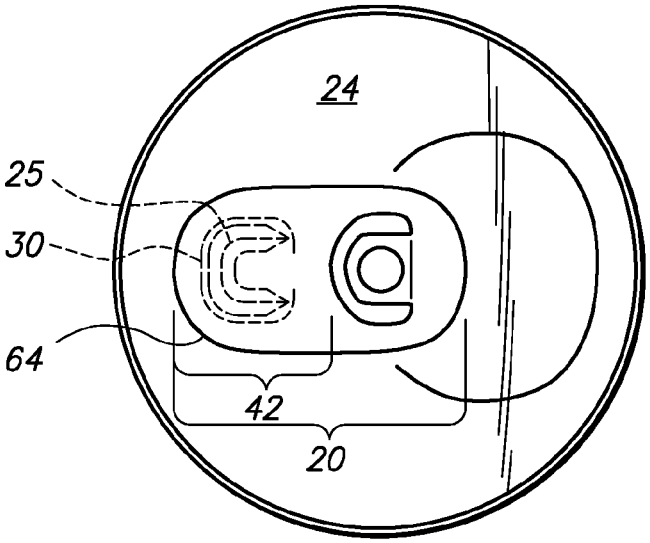
FIG. 7 is a top view of the improved can shown in FIG. 1.

Referring back to FIG. 4, the vent opening portion 42 may have a length 60 that is greater than a distance 62 from the pivot point 48 to a second score line 30. When the user pushes down on the vent opening portion 42 to open the vent opening 26 (see FIG. 6), the vent opening portion 42 hits the upper panel 24 and does not proceed through the vent opening 26, as shown in FIG. 6. As shown in FIG. 7, the vent opening portion 42 is substantially larger than the second score line 30.

Figure 8:
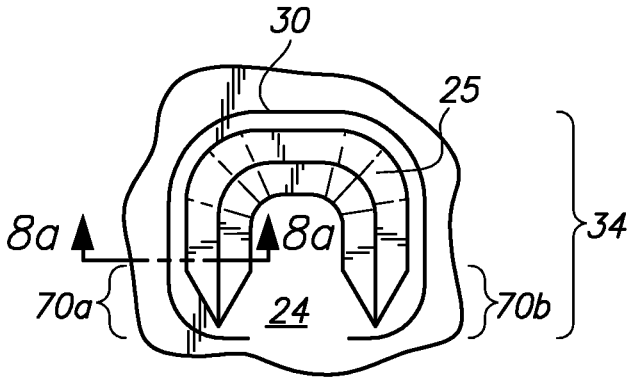
FIG. 8 is an enlarged view of a ridge for providing leverage to the tab to open the vent opening.

Referring now to FIG. 8, the cut out portion 34 may be formed with the ridge 25 which may serve the function of providing leverage to assist the user in breaking the score line 30. In particular, the user pushes downward on the vent opening portion 42. As the user pushes down on the vent opening portion 42, the vent opening portion 42 places pressure on the ridge 25, as shown in FIG. 6. The user increases pressure until the pressure applied to the ridge 25 is transferred to the score line 30 and is sufficient to break the score line 30 and open the vent opening 26. Once the score line 30 is broken, the user's finger will accelerate toward the upper panel 24. Fortunately, the vent opening portion 42 of the tab 20 is sufficiently long to press against the upper panel 24 and prevent entrance of the person's thumb or finger into the vent opening 26, as shown in FIG. 6. When the vent opening portion 42 contacts the upper panel 24, the vent opening portion 42 continues to push and deflect the cut out portion 34 away from the upper panel 24. This deflection permanently deforms the cut out portion 34 to increase the gap between the cut out portion 34 and the upper panel 24, as shown in FIG. 3.

Referring now to FIG. 7, a top view of the upper panel 24 and the tab 20 are shown. As can be seen, the outer periphery 64 of the vent opening portion 42 may cover the second score line 30. The vent opening portion 42 also covers the ridge 25 so as to be sure that the vent opening portion 42 of the tab 20 contacts the ridge 25 as the user pushes down on the vent opening portion 42 to open the vent opening 26.

Figure 8A:
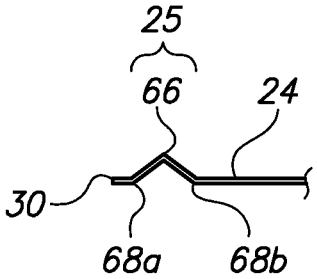
FIG. 8A is a cross sectional view of the ridge shown in FIG. 8.
Figure 9:
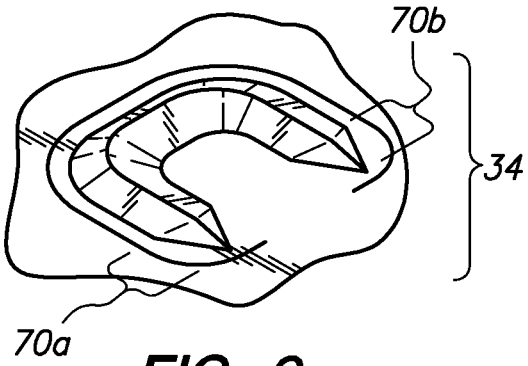
FIG. 9 is a perspective view of the ridge shown in FIG. 8.

Referring now to FIGS. 8 and 9, a top view of the cut out portion 34 and ridge 25 and a perspective view thereof are shown. FIG. 8A is a cross sectional view of the ridge 25 shown in FIG. 8. The ridge 25 is closely adjacent the second score line 30 so that sufficient leverage is applied to the cut out portion 34 as the user presses down on the vent opening portion 42 of the tab 20. The ridge 25 extends from the cut out portion 34 and is deformed upward in a stamping process. The ridge 25 defines a spine 66 which rises from feet 68*a, b* of the upper panel 24, as shown in FIG. 8A. The ridge 25 is preferably located as close as possible to the score line 30 to provide maximum leverage to the user. The distal end portions 70*a, b* are tapered and blended downward into the upper panel 24 so as to have a gradually declining ridgeline. The ridge 25 may have a horseshoe shape.

Figure 10:
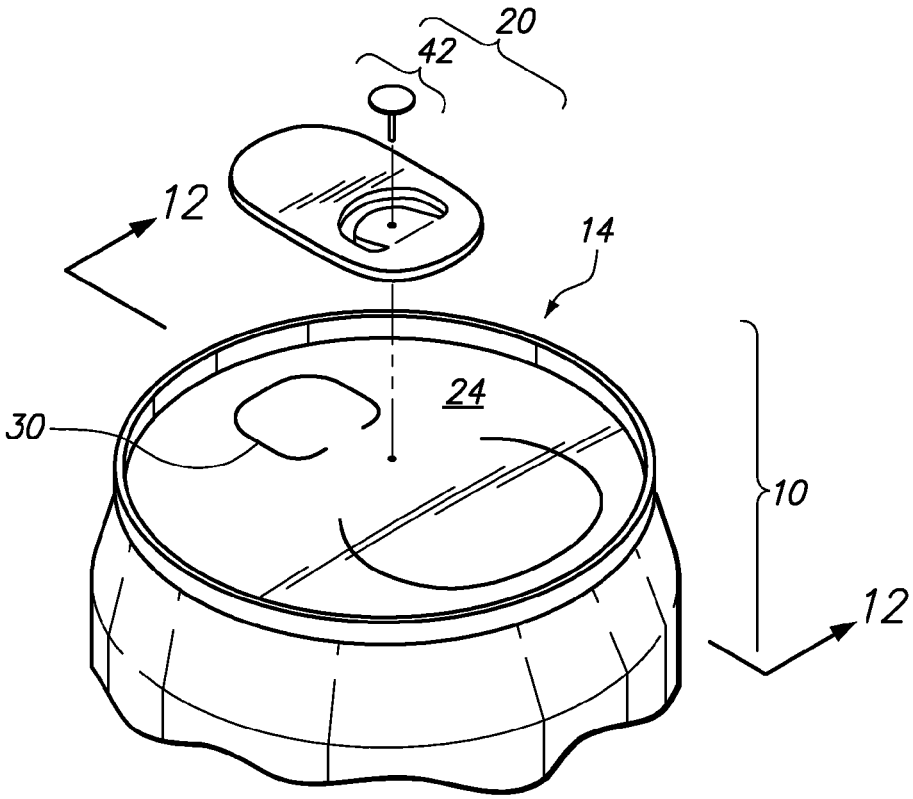
FIG. 10 is an enlarged exploded view of a top end of an improved can in accordance with a second embodiment.
Figure 11:
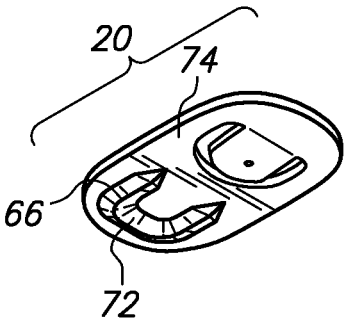
FIG. 11 is a bottom perspective view of the tab shown in FIG. 10 illustrating a raised ridge for breaking a second score line formed in a top end of the improved can shown in FIG. 10.
Figure 12:
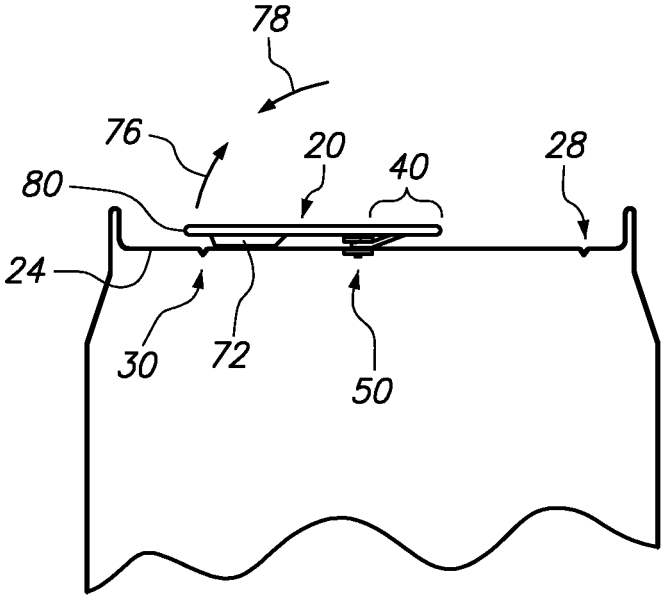
FIG. 12 is a cross sectional view of an assembled can shown in FIG. 10.

Referring now to FIGS. 10-12, a second embodiment is shown. In particular, a raised ridge 72 having the same configuration as the ridge 25 is formed on an underside 74 of tab 20. The raised ridge 72 may also have a spine 66 which may be closely aligned to the inner periphery of the second score line 30 formed in the upper panel 24 of the top end 14 of the can 10. The raised ridge 72 may have a corresponding configuration as that of the second score line 30. In the example shown in the Figures, the second score line 30 has a horseshoe configuration. The ridges 25, 72 may also have a horseshoe configuration. This is to allow the raised ridges 25, 72 to apply maximum leverage to break the score line 30 when the user compresses the vent opening portion 42 of the tab 20. The raised ridges 25, 72 attempt to apply as much pressure to the second score line 30 along as much of the length of the second score line 30 as possible.

Referring now to FIG. 12, the tab 20 may be pivotally attached to the upper panel 24 by way of rivet 50. The user may initially pull up on the tab 20 as shown by arrow 76 to pivot the tab 20 about rivet 50. The drink opening portion 40 presses down on the upper panel 24 to break the first score line 28. After the first score line 28 is broken, the user may traverse the tab 20 back down in the direction of arrow 78. The ridge 72 formed on the underside 74 of the tab 20 presses down on the upper panel 24 and applies pressure to the second score line 30. The user continues to apply pressure until the second score line 30 is broken. Upon rupture, the distal end 80 of the vent opening portion 42 contacts the upper panel 24 to prevent the user's finger from being pushed in through the vent opening 26 which may have a sharp edge at the second score line 30 that could cut the user.

In the discussion above in relation to the embodiments of the improved can 10, the tab 20 was initially raised upward to open the drink opening 22, then rotated back downward to open the vent opening 34. However, it is also contemplated that the reverse may also be performed. In particular, the user may press down on the vent opening portion 42 to apply pressure to the second score line 30 by way of ridges 25, 72. After the second score line 30 is broken, the tab 20 will spring back upward and allow the user to grasp the underside 74 of the vent opening portion 42 of the tab 20 to pull upward on the tab 20 and apply pressure to and break the first score line 28 by way of the drink opening portion 40.

Figure 2A:
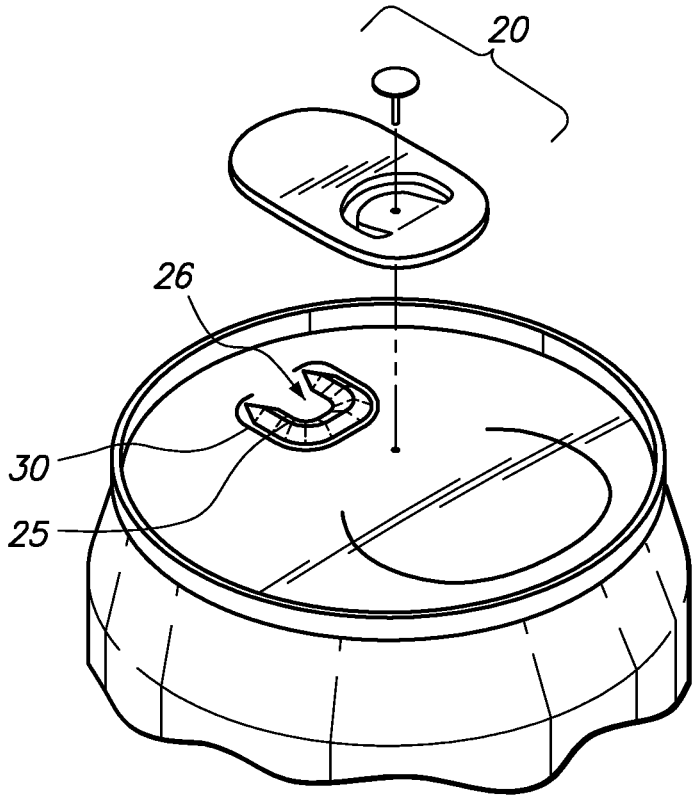
FIG. 2A is an enlarged exploded view of the top end of the improved can with the vent opening shown in an upside down configuration.
Figure 10A:
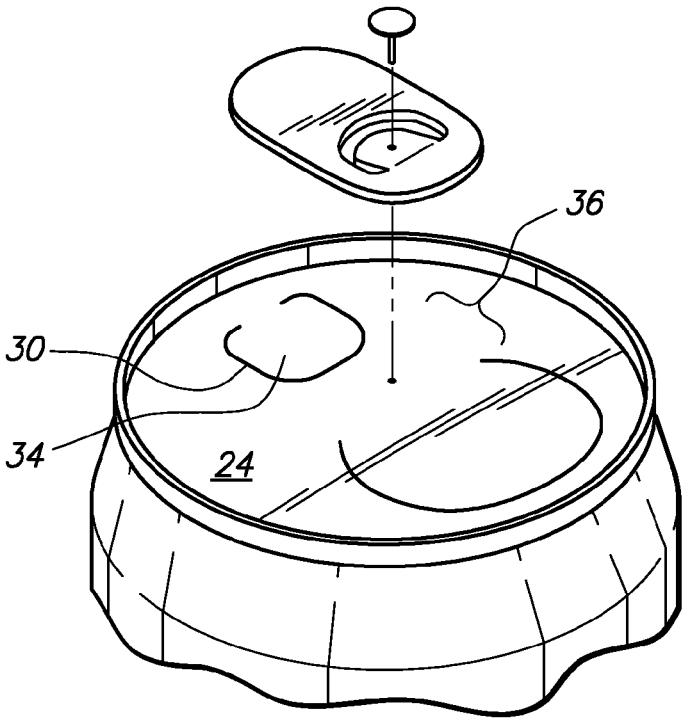
FIG. 10A is an enlarged exploded view of a top end of an improved can in accordance with the second embodiment wherein a second score line is in an upside down configuration.
Figure 11A:
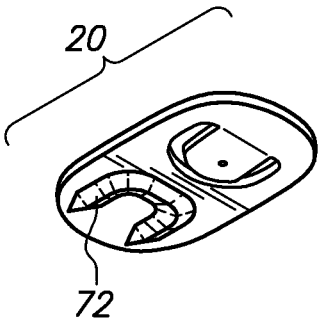
FIG. 11A is a bottom perspective view of the tab shown in FIG. 10A illustrating a raised ridge for breaking the second score line formed in the top end of the improved can shown in FIG. 10A.

Referring back to FIG. 2, the second score line 30 has a horseshoe configuration wherein the cutout portion 34 is attached to the central portion 36 of the upper panel 24. However, it is also contemplated that the second score line 30 may have an upside down horseshoe configuration as shown in FIG. 2A. The tab 20 still pushes down on the raised ridge 25. The overhang of the tab 20 beyond the raised ridge 25 provides a mechanical advantage to further provide leverage to apply pressure to the raised ridge 25 and break the second score line 30 to form the vent opening 26. In this instance, the cutout portion 34 is not attached to the central portion 36 but attached to the peripheral portion of the upper panel 24. The vent opening 26 is in the opposite direction. The same may also be implemented in the second embodiment shown in FIGS. 10-12. Referring now to FIG. 10A, the second score line 30 is reconfigured in an upside down configuration. The cutout portion 34 is attached to the peripheral portion of the upper panel 24 not the central portion 36 thereof. The raised ridge 72 formed on the underside surface of the tab 20 is also reconfigured to be the mirror images compared to FIG. 11 (see FIG. 11A).

In the drawings and description above, the vent opening 26 was shown and described as being opposite (i.e., angularly displaced 180°) from the drink opening 22. However, it is also contemplated that the vent opening 26 may be positioned on the upper panel 24 of the top end 14 at a different angular displacement with respect to the drink opening 22. By way of example and not limitation, the vent opening 26 may be located 90° or 120° away from the drink opening 22. Moreover, any angular displacement of the vent opening 26 from the drink opening 22 is contemplated. To open the vent opening 26, the tab 20 may be rotated about rivet 50 so that the tab 20 is aligned to ridge 25 or score line 30 and the tab 20 can be pushed down and the ridge 25 or 72 may apply pressure to the second score line 30 to break or rupture the same.

Referring back to FIG. 8A, the ridge 25 is shown as being a triangular shape. However, other shapes for the ridge 25 are also contemplated. By way of example and not limitation, the ridge 25 may have a rounded configuration, a squared configuration, etc. Additionally, the ridge 25 may be formed by way of a folded bead instead of a stamping process. The same is also true for the ridge 72 formed in the tab 20 which is discussed as an alternative embodiment. The ridge 72 may also have other configurations such as triangular, squared, rounded, etc. Also, the ridge 72 may be formed by a bead of material. The ridges 25, 72 may be any type of raised surface including but not limited to a raised protrusion or any feature that extends above the upper panel 24 of the can 10 or below the underside surface 74 of the tab 20.

The above description is given by way of example, and not limitation. Given the above disclosure, one skilled in the art could devise variations that are within the scope and spirit of the invention disclosed herein, including various ways of attaching the tab 20 to the top end 24 of the can 10. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A can for containing fluid therein, the can comprising:

a bottom end;

a cylindrical sidewall with the bottom end attached to a first side of the cylindrical sidewall;

a top end attached to the sidewall on an opposed second side of the cylindrical sidewall to form an enclosed volume in which the fluid is containable, the top end having a first score line defining a drinking periphery formed in the top end and a second score line defining a vent opening, the first score line angularly displaced from the second score line with respect to a center portion of the top end, the top end having a deformation juxtaposed to an inner periphery of the second score line;

a tab defining a drink opening portion and a vent opening portion, the drink and vent opening portions joined to each other at an intermediate portion, the intermediate portion pivotally attached to the center portion of the top end, the drink opening portion disposed over the top end on an interior side of the first score line, the vent opening portion disposed over the top end with a solid portion of the vent opening portion disposable over the deformation;

wherein the vent opening portion is disposable over the second score line and the deformation has a sloping side that extends to a spine.

2. The can of claim 1 wherein the first and second score lines are displaced 120 degrees from each other with respect to the center portion of the top end.

3. The can of claim 1 wherein the second score line defines a cut out attached to a peripheral portion of the top end.

4. The can of claim 1 wherein a distal end of the drink opening portion of the tab is closer to the center portion of the top end than the first score line so as to provide leverage when a user lifts the vent opening portion to break the first score line and provide for the drink opening.

5. The can of claim 1, wherein the deformation is closer to the second score line compared to the center portion of the top end.

6. The can of claim 1, wherein the deformation is a protrusion.

7. The can of claim 2 wherein the tab is rotatable shoot the tab intermediate portion to dispose the vent opening portion of the tab over the deformation.

8. The can of claim 1, wherein the spine extends above an upper surface of the top end of the can.

9. The can of claim 1, wherein the deformation comprises at least one ridge, and the at least one ridge comprises contiguous portions of opposing sides raised above the upper surface of the top end defining the spine.

10. The can of claim 1, wherein the second score line is disposed between the center portion of the top end and the deformation.

11. A method of opening a fluid containable can, the method comprising the steps of:

providing a drink opening defined by a first score line and a vent opening defined by a second score line on a top end of the can, the first and second score lines being angularly displaced from each other with respect to an intermediate portion of a tab;

lifting a vent opening portion of the tab to pivot the tab about the intermediate portion of the tab so as to provide leverage to a drink opening portion of the tab;

pressing the drink opening portion into the top end of the can to break the first score line on the top end of the can;

breaking the first score line;

contacting the vent opening portion of the tab into a deformation formed in the top end of the can, wherein the deformation comprises a spine with a sloping side;

pushing the vent opening portion of the tab into the protrusion formed in the too end of the can to break the second score line on the top end of the can;

breaking the second score line on the top end of the can to open the vent opening.

12. The method of claim 11 wherein the vent opening and the drink opening are angularly displaced at an angle other than 180 degree from each other with respect to the intermediate portion of the tab.

13. A can for containing fluid therein, the can comprising:

a bottom end;

a cylindrical sidewall with the bottom end attached to a first side of the cylindrical sidewall;

a top end attached in the sidewall on an opposed second side of the cylindrical sidewall to form an enclosed volume in which the fluid is containable, the top end having a first score line defining a drinking periphery formed in the top end and a second score line defining a vent opening, the first score line angularly displaced from the second score line at an angle other than 180 degrees with respect to a center portion of the top end, the top end having a deformation juxtaposed to an inner periphery of the second score line, the second score line interposed between the deformation and the center portion of the top end;

a tab defining a drink opening portion and a vent opening portion, the drink and vent opening portions joined to each other at an intermediate portion, the intermediate portion pivotally attached to the center portion of the top end, the drink opening portion disposed over the top end on an interior side of the in score line, the vent opening portion disposed over the top end with a solid portion of the vent opening portion disposable over the second score line.

14. The can of claim 13 wherein the second score line has an upside down horseshoe configuration with respect to the first score line.

15. The can of claim 13 wherein the second score line is oriented in an opposite direction from the first score line when rotated about the center portion of the top end.

16. The can of claim 13 wherein the first score line is angularly displaced from the second score line at an angle of about 120 degrees with respect to the center portion of the top end.

17. The can of claim 13 wherein the second score line defines a cut out attached to a peripheral portion of the top end.

18. The can of claim 13 wherein an underside of the vent opening portion of the tab has a protrusion for breaking the second score line.

19. The method of claim 13 further comprising the step of rotating the tab about the center portion until the vent opening portion is aligned to the deformation.

* * * * *